US011629709B2

(12) United States Patent
Theodore, Jr. et al.

(10) Patent No.: US 11,629,709 B2
(45) Date of Patent: Apr. 18, 2023

(54) VAPOR INJECTED PISTON COMPRESSOR

(71) Applicant: Hanon Systems, Daejeon (KR)

(72) Inventors: Michael G. Theodore, Jr., Plymouth, MI (US); Kanwal Bhatia, Canton, MI (US); Carl Cordy, Ypsilanti, MI (US)

(73) Assignee: HANON SYSTEMS, Daejeon (KR)

( * ) Notice: Subject to any disclaimer, the term of this patent is extended or adjusted under 35 U.S.C. 154(b) by 460 days.

(21) Appl. No.: 16/901,095

(22) Filed: Jun. 15, 2020

(65) Prior Publication Data

US 2021/0388827 A1 Dec. 16, 2021

(51) Int. Cl.
*F04B 27/10* (2006.01)

(52) U.S. Cl.
CPC ..... *F04B 27/1045* (2013.01); *F04B 27/1018* (2013.01)

(58) Field of Classification Search
CPC .. F04B 27/10; F04B 27/1009; F04B 27/1018; F04B 27/1045
See application file for complete search history.

(56) References Cited

U.S. PATENT DOCUMENTS 5,253,489 A 10/1993 Yoshii
6,053,081 A 4/2000 Kimura et al.
6,675,607 B2 1/2004 Tarutani et al.
9,470,224 B2 * 10/2016 Ban ..... F04B 49/24
2003/0095873 A1 * 5/2003 Tarutani ..... F04B 27/1018 417/269
2003/0113211 A1 * 6/2003 Moroi ..... F04B 27/1063 417/222.2
2005/0265855 A1 * 12/2005 Ota ..... F04B 27/1018 417/515
2014/0127061 A1 * 5/2014 Ban ..... F04B 27/1081 417/437
2015/0093263 A1 * 4/2015 Kimoto ..... F04B 27/12 417/222.2

* cited by examiner

*Primary Examiner* — Devon C Kramer
*Assistant Examiner* — Joseph S. Herrmann
(74) *Attorney, Agent, or Firm* — Shumaker, Loop & Kendrick, LLP; James D. Miller

(57) ABSTRACT

A piston type compressor has a main housing including a cylinder housing. The cylinder housing has a central bore for receiving a shaft therein through a first surface thereof and a plurality of bores configured for receiving a plurality of pistons therein through the first surface thereof. An inlet is configured for conveying a primary fluid to the plurality of bores. An outlet is configured for conveying the primary fluid from the plurality of bores. A plurality of passages is separate from the inlet and the outlet. Each of the plurality of passages is formed in the main housing and is configured for conveying a supplemental fluid to one of the plurality of bores.

15 Claims, 5 Drawing Sheets

VAPOR INJECTED PISTON COMPRESSOR

FIELD OF THE INVENTION

The invention relates to compressors and particularly to a vapor injected piston compressor having ports directly injecting fluid into a cylinder housing of the compressor.

BACKGROUND OF THE INVENTION

As commonly known, vehicles typically include a heating, ventilating, and air conditioning (HVAC) system. The HVAC system maintains a temperature within a passenger compartment of the vehicle at a comfortable level for a passenger by providing a desired heating, cooling, and ventilation to the passenger compartment. The HVAC system conditions air flowing therethrough and distributes the conditioned air throughout the passenger compartment.

Piston type, variable or fixed, refrigerant compressors are commonly employed in HVAC systems of vehicles. These compressors are typically sized, designed, and configured depending on the application. One of the factors in determining the size, design, and configurations of the compressors is the displacement of cylinders or pistons of the compressors required to cause the compressors to efficiently cool a passenger compartment of the vehicle to a desired temperature within an interval of time after the vehicle has been stationary for an interval of time. The interval of time it takes the compressor to cool the passenger compartment to the desired temperature is call the "pull down." If the compressor achieves the "pull down" within a desired interval of time, then the compressor is configured correctly.

Currently, in order to achieve the "pull down" within the desired interval of time, the vehicles are provided with compressors having increased maximum displacement, wherein a size, such as length and diameter, of the cylinder bores of the compressor are increased or a number of cylinders is increased. As a result, an increase in refrigerant mass flow through the compressor is increased which results in greater heating and/or cooling capacity for the vehicle.

However, increasing displacement of the compressors can be problematic. First, a compressor with a larger maximum displacement occupies a larger amount of space. Second, increasing the maximum displacement of the compressor results in a greater mass of the compressor (i.e. additional material and components) which increases a cost of manufacture. Third, for variable displacement compressors, an efficiency of the compressor is decreased with an increase in maximum displacement of the compressor. For example, when "pull down" is achieved, a variable displacement compressor will operate in variable mode. As the maximum displacement increases, a bore-to-stroke ratio decreases in the variable mode which results in high power and energy consumption for heating and/or cooling. The higher the power and energy consumption, the greater the undesired emissions from the vehicle.

In an attempt to resolve the aforementioned problems, an alternative option to increasing the maximum displacement of the compressor is known. The alternative option is to employ a vapor injected compressor. Such vapor injected technology is employed with scroll compressors. However, including vapor injected technology with piston compressors has typically been problematic. Injecting vapor into a piston compressor typically results in the vapor being injected into the suction chamber of the compressor. As a result, a temperature of the vapor in the suction chamber and during suction, caused by the cylinders in the cylinder housing, is increased and re-expansion of the vapor, at high pressure, is caused. This results in previously expended work to be lost. Minimizing the expansion of high pressure vapor prior to injection into the cylinder bores is desirable to ensure that a minimum of compression work is lost. Maximizing a density of the vapor injected into the cylinders is essential in realizing a maximized mass flow through the compressor can be realized.

Other attempts at introducing vapor to the compressor typically result in increased clearance or dead volume of the cylinders in the cylinder bores which also decreases the efficiency of the compressor and increases in undesired emissions.

It would therefore be desirable to provide a vapor injected piston compressor minimizing an increase in a maximum displacement of the compressor and a cost of manufacture while maximizing an efficiency of the compressor.

SUMMARY OF THE INVENTION

In accordance and attuned with the present invention, a vapor injected piston compressor minimizing an increase in a maximum displacement of the compressor and a cost of manufacture while maximizing an efficiency of the compressor has surprisingly been discovered.

According to an embodiment of the disclosure, a piston type compressor has a main housing including a cylinder housing. The cylinder housing has a central bore for receiving a shaft therein through a first surface thereof and a plurality of bores configured for receiving a plurality of cylinders therein through the first surface thereof. An inlet is configured for conveying a primary fluid to the plurality of bores. An outlet is configured for conveying the primary fluid from the plurality of bores. A plurality of passages is separate from the inlet and the outlet. Each of the plurality of passages is formed in the main housing and is configured for conveying a supplemental fluid to one of the plurality of bores.

According to another embodiment of the disclosure, a piston type compressor is disclosed The compressor includes a cylinder housing. The cylinder housing has a central bore and a plurality of cylinder bores formed therethrough. A shaft is received through the central bore through a first surface of the cylinder housing. A plurality of pistons reciprocates within the plurality of cylinder bores through the first surface of the cylinder housing. A plurality of passages provides fluid communication between the central bore and the plurality of cylinder bores.

According to a further embodiment of the disclosure, a method of forming a plurality of fluid passages in a cylinder house of a compressor includes the steps of providing a cylinder block and forming a central bore through the cylinder block and a plurality of cylinder bores spaced radially outwardly from the central bore. The method includes the steps of rotating the cylinder block and inserting a tool through the central bore at an angle with respect to an axial direction of the central bore. Additionally, the method includes the step of boring the plurality of passages through the cylinder block with the tool as the cylinder block rotates. Each of the plurality of passages extends from the central bore to one of the plurality of cylinder bores.

BRIEF DESCRIPTION OF THE DRAWINGS

The above, as well as other objects and advantages of the invention, will become readily apparent to those skilled in the art from reading the following detailed description of an embodiment of the invention when considered in the light of the accompanying drawing which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

A" and "an" as used herein indicate "at least one" of the item is present; a plurality of such items may be present, when possible. Spatially relative terms, such as "front," "back," "inner," "outer," "bottom," "top," "horizontal," "vertical," "upper," "lower," "side," "above," "below," "beneath," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures.

As used herein, substantially is defined as "to a considerable degree" or "proximate" or as otherwise understood by one ordinarily skilled in the art. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Where any conflict or ambiguity may exist between a document incorporated by reference and this detailed description, the present detailed description controls. Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
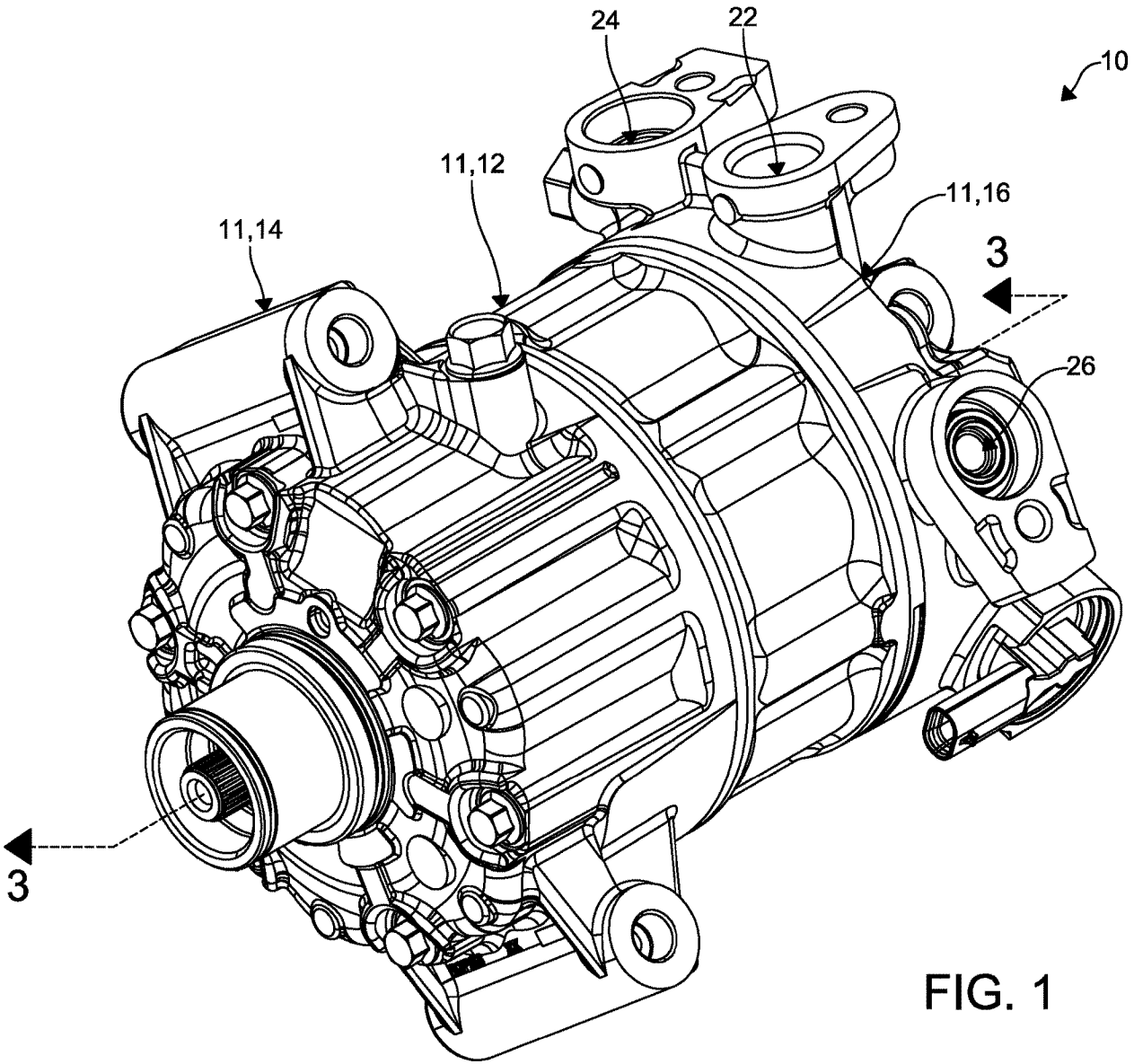
FIG. 1 is a front perspective view of a compressor according to the instant disclosure.
Figure 2:
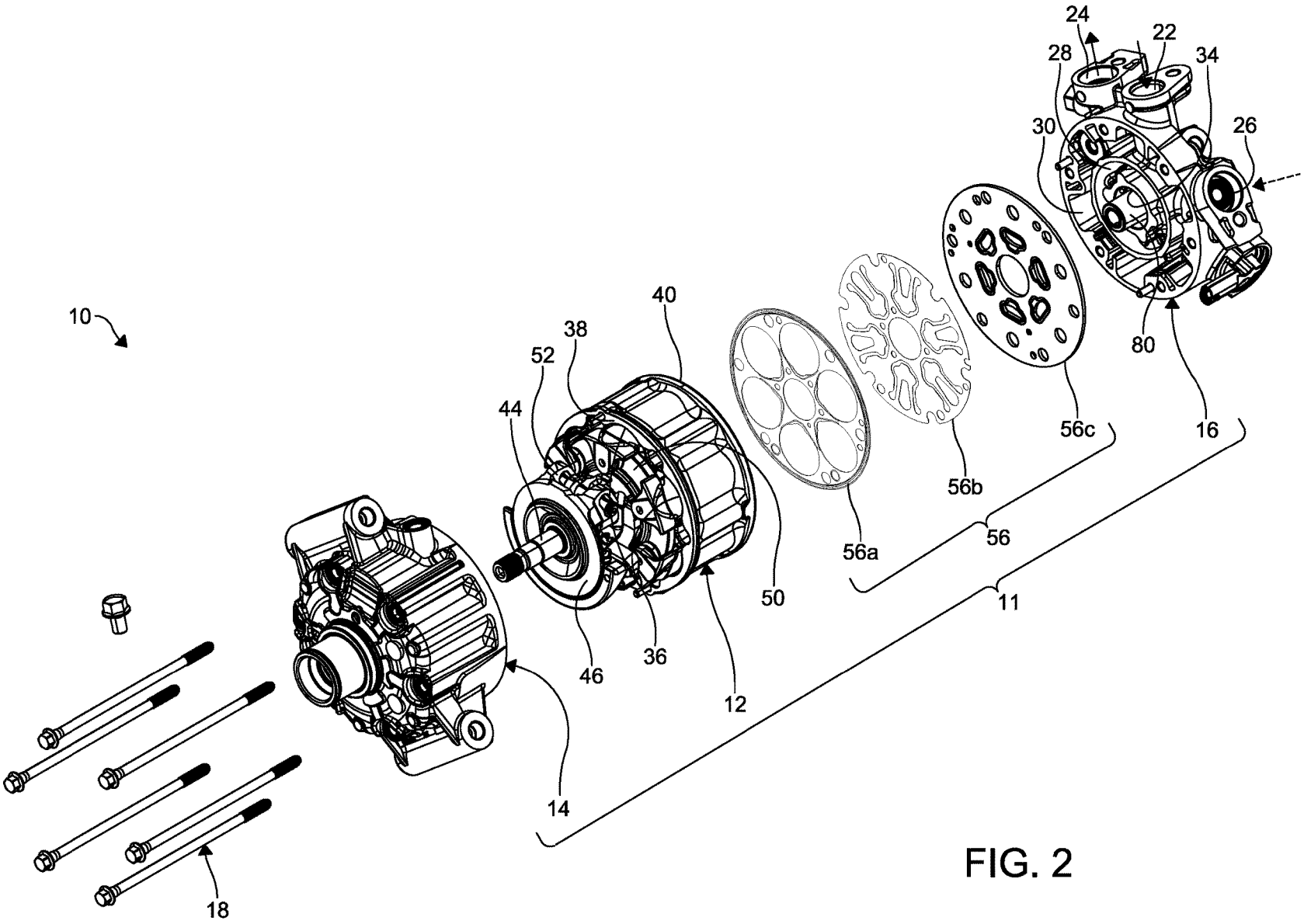
FIG. 2 is a partially exploded front perspective view of a housing of the compressor of FIG. 1.

FIG. 1 illustrates a compressor 10 according to an embodiment of the instant disclosure. The compressor 10 shown is configured as a variable displacement compressor. However, the compressor 10 can be any piston compressor as desired, variable displacement or non-variable displacement. The compressor 10 includes a housing 11. The housing 11 is formed from a cylinder block or cylinder housing 12, a front housing 14 coupled to a first end or a first surface 38 of the cylinder housing 12 and a rear housing 16 coupled to a second end or a second surface 40 of the cylinder housing 12. The front housing 14, the rear housing 16, and the cylinder housing 12 are coupled to each other with rods and bolts 18. However, the housings 12, 14, 16 can be coupled by other coupling devices or methods.

The rear housing 16 includes a plurality of ports 22, 24, 26. The ports 22, 24, 26 are configured as an intake or a suction port 22, a discharge or an exhaust port 24, and a vapor injection port 26. The suction port 22 receives a primary fluid (shown by a solid arrow) such as a refrigerant, for example, from a first fluid source and conveys the primary fluid to the cylinder housing 12. The exhaust port 24 conveys the primary fluid from the cylinder housing 12 back to the first fluid source. The vapor injection port 26 receives a supplemental fluid (shown by a dashed arrow) such as a refrigerant, for example, from a second fluid source. The first fluid source can be the same as the second fluid source. For example, the fluid sources can be a refrigerant circuit of a heating, ventilation, and air conditioning (HVAC) system of a vehicle. The vapor injection port 26 can receive the supplemental fluid at the same density and pressure as or a different density and pressure from the primary fluid being received by the suction port 22. It has been found to be advantageous for the vapor injection port 26 to receive the supplemental fluid at an increased density or maximum density compared to the primary fluid flowing from the second fluid source. However, the vapor injection port 26 can receive the supplemental fluid at any density or having any property that may be advantageous for increasing efficiency of the compressor 10.

As shown in FIGS. 2-5, the rear housing 16 includes a suction chamber 28, an exhaust chamber 30, and a vapor injection chamber 34 in fluid communication with a plurality of bores 32 formed in the cylinder housing 12. The bores 32 are in fluid communication with the suction port 22 via the suction chamber 28, the exhaust port 24 via the exhaust chamber 30, and the vapor injection port 26 via the vapor injection chamber 34. The suction chamber 28, the exhaust chamber 30, and the vapor injection chamber 34 are concentric with each other. However, it is understood, the chambers 28, 30, 34 can be arranged with respect to each other in other positions such as aligned or sporadically arranged, or any other arrangement as desired.

The bores 32 are radially formed through the cylinder housing 12 about a central bore 33. The bores 32 extend from the first surface 38 of the cylinder housing 12 to the second surface 40 of the cylinder housing 12. Each of the bores 32 receives a piston or cylinders 36 therein. Each of the pistons 36 are capable of linearly reciprocating within a respective one of the bores 32 along a length 1 of the bores 32. As illustrated, there are six of the bores 32 for receiving six of the pistons 36. However, there can be greater than or fewer than six of the bores 32 depending on the number of the pistons 36 required for a given application.

A shaft 44 extends through a crank chamber 43 in the front housing 14 and the central bore 33 of the cylinder housing 12. The shaft 44 rotates by driving means commonly known in the art for piston compressors. For example, the driving means can be a pulley or belt driven by a device of the vehicle such as an engine of the vehicle or a motor, a chain, another shaft, a gear system, or any other driving means as desired. The driving means can include bearings, bushings, clutches, and similar type devices commonly employed with rotary motion. A rotor 46 is disposed within the crank chamber 43 adjacent one end of the shaft 44. The rotor 46 integrally rotates with the shaft 44. The rotor 46 is positioned within the crank chamber 43 in such a manner to position the shaft 44 in a central position within the crank chamber 43 to align with the central bore 33 of the cylinder housing 12.

A swash plate 50 is disposed about the shaft 44 and spaced from the rotor 46. The swash plate 50 is in rotational communication with the rotor 46, wherein the swash plate 50 integrally rotates with the rotor 46. As a result, the swash plate 50 also rotates integrally with the shaft 44. For example, the swash plate 50 is coupled to the rotor 46 by a hinge assembly 52, wherein the hinge assembly 52 includes a first hinge portion extending outwardly from a surface of the rotor 46 into the crank chamber 43 and a second hinge portion extends outwards from the swash plate 50 towards the first hinge portion. The hinge portions are coupled to each other via a hinge pin. A spring (as shown) may also be positioned between the rotor 46 and the swash plate 50 to bias the swash plate 50 away from the rotor 46. Although, other coupling mechanisms can be employed as desired. According to the present disclosure, the hinge assembly 52 causes the swash plate 50 to be disposed at an angle with respect to an axial direction of the shaft 44 from greater than parallel (0 degrees) to substantially perpendicular (90 degrees) to the axial direction of the shaft 44. The swash plate 50 tilts with respect to the shaft 44. Therefore, the angle of the swash plate 50 in the variable displacement compressor can vary between the aforementioned range.

Figure 3:
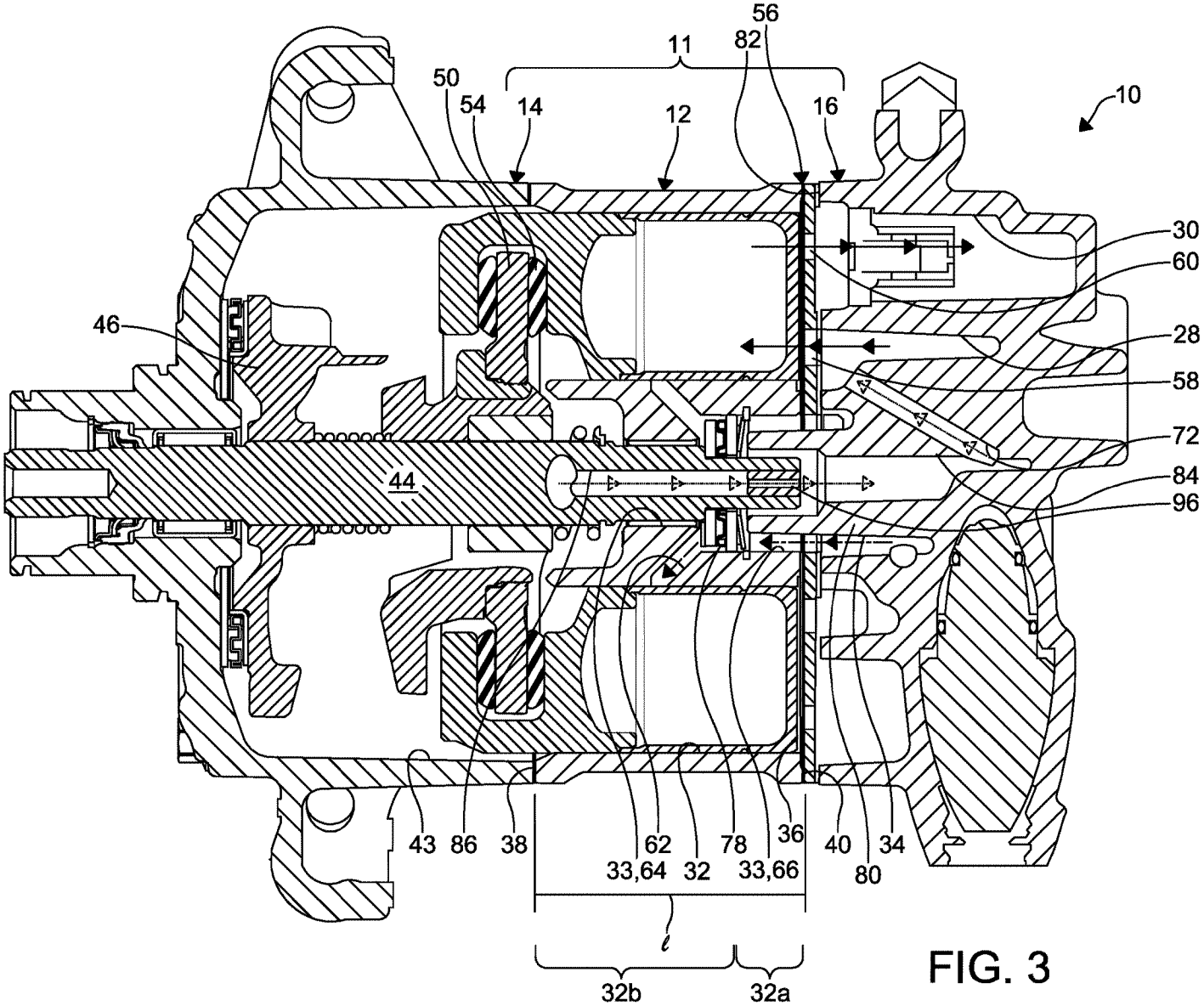
FIG. 3 is left side cross-sectional elevational view of the compressor of FIG. 1, taken through lines 3-3.
Figure 4:
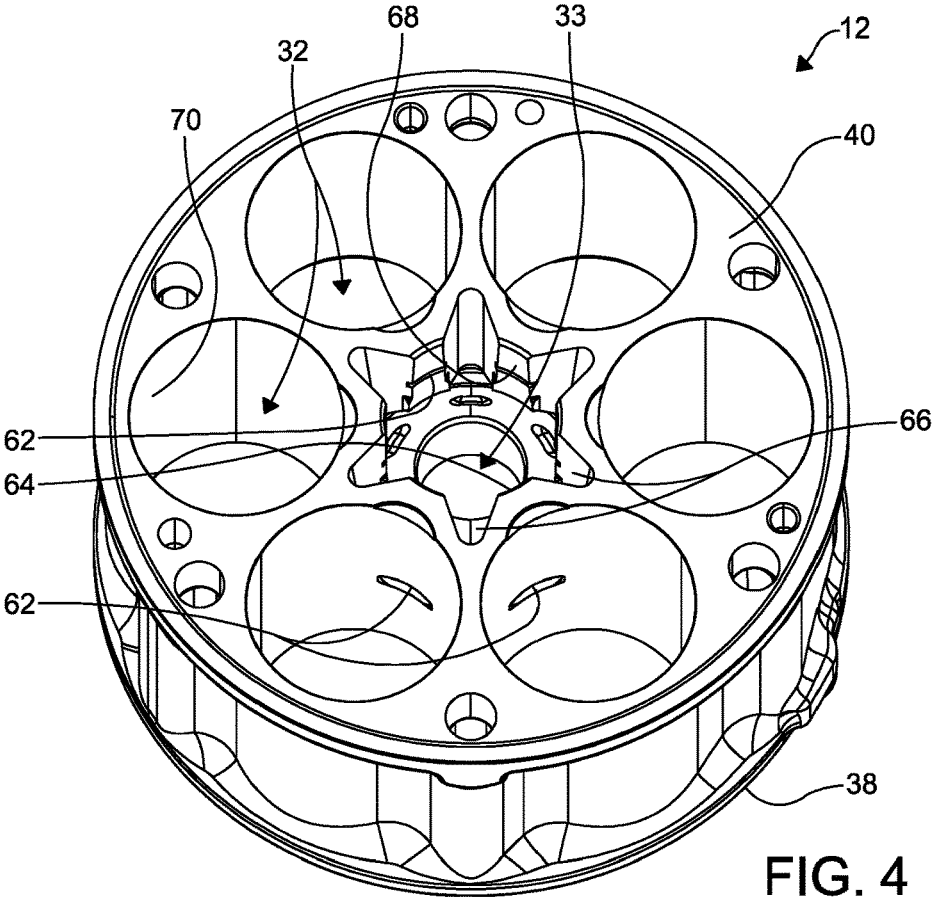
FIG. 4 is a rear perspective view of a cylinder housing of the compressor of FIGS. 1-3.
Figure 5:
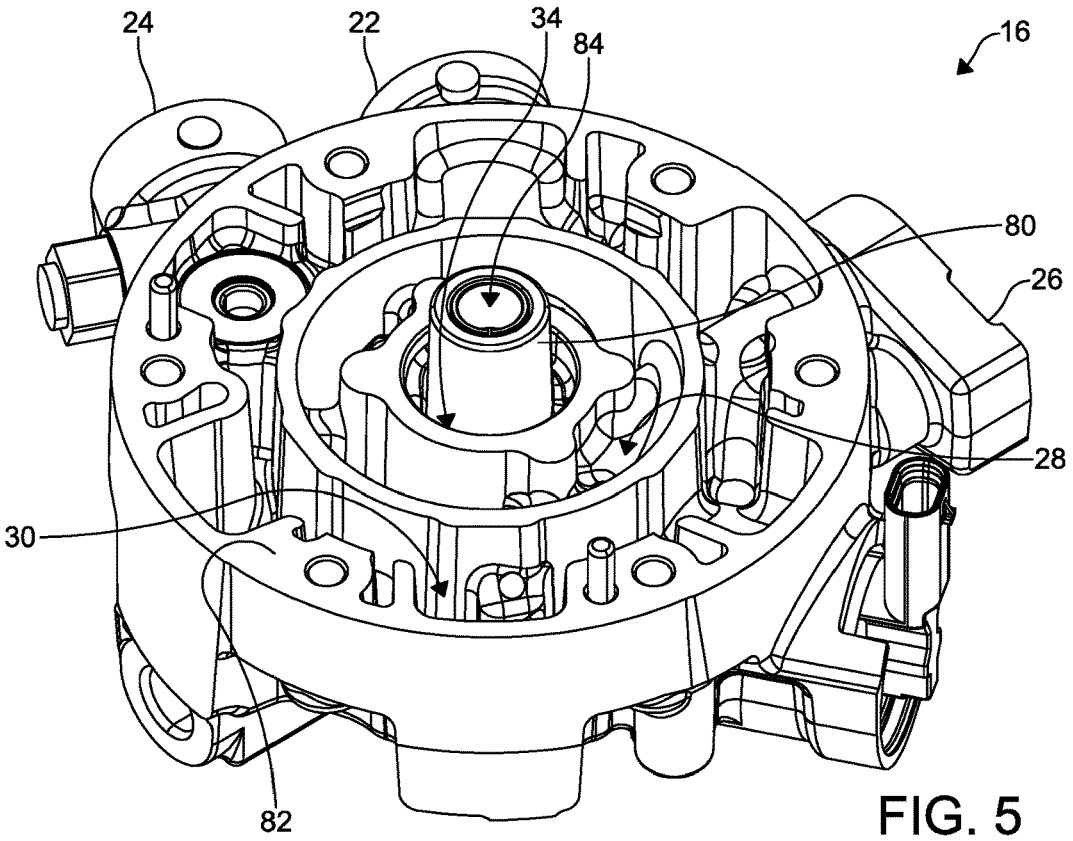
FIG. 5 is a front perspective view of a rear housing of the compressor of FIGS. 1-3.

The swash plate 50 is coupled to each of the pistons 36 by shoes 54 disposed at an outer circumferential edge of the swash plate 50. As a result, the rotational movement of the swash plate 50 is converted to reciprocating linear movement of the pistons 36. The pistons 36 reciprocate within the bores 32 at a greater linear distance when the swash plate 50 is disposed at an angle approaching zero degrees with respect to the shaft 44 and at a smaller linear distance when the swash plate 50 approaches 90 degrees or perpendicular to the shaft 44. As shown in FIG. 3, the swash plate 50 is positioned in a position substantially perpendicular to the axial direction of the shaft 44 for illustrative purposes in accordance with the present disclosure.

A valve assembly 56 is disposed intermediate the cylinder housing 12 and the rear housing 16. The valve assembly 56 includes a first plate 56*a*, a second plate 56*b*, and a third plate 56*c*. The first plate 56*a* is adjacent the cylinder housing 12, the second plate 56*b* is disposed intermediate the first plate 56*a* and the third plate 56*c*, and the third plate 56*c* is disposed intermediate the second plate 56*b* and the rear housing 16. The plates 56*a*, 56*b*, 56*c* cooperate with each other to define an inlet 58 and outlet 60 through the valve assembly 56. The inlet 58 is configured for conveying the primary fluid from the suction chamber 28 to the bores 32 to be compressed by the pistons 36 and the outlet 60 is configured for conveying the compressed fluids (the primary fluid and/or the supplemental fluid) from the bores 32 to the exhaust chamber 30.

The central bore 33 has a substantially circular cross-sectional first portion 64 and a second portion 66 defined by a plurality of radially extending recesses continuous with the first portion 64. Each of the recesses extends to a space intermediate adjacent ones of the bores 32. In the embodiment illustrated, there are six of the recesses defining the second portion 66. The first portion 64 and the second portion 66 cooperate to form a substantially hexagram cross-sectional shape of the central bore 33. However, it is understood, the central bore 33 can include more than or fewer than six of the recesses to define the second portion 66 thereof depending on the number of the bores 32. In the embodiment illustrated, the recesses forming the second portion 66 of the central bore 33 have a substantially triangular cross-section shape. However, the second portion 66 of the central bore 33 can have alternate shapes as desired such as polygonal, ovular, circular, elongate, or any shape or combination of shapes as desired. The second portion 66 of the central bore 33 is configured as a chamber for receiving the supplemental fluid from the vapor injection chamber 34 so the supplemental fluid flows around the shaft 44.

The cylinder housing 12 includes a plurality of passages 62 each extending from the central bore 33 to one of the bores 32, wherein each of the passages 62 extend from a wall 68 defining the central bore 33 to a wall 70 defining a respective one of the bores 32. Each of the passages 62 extend from the first portion 64 of the central bore 33 intermediate adjacent ones of the recesses forming the second portion 66. The passages 62 are continuous between adjacent ones of the recesses forming the second portion 66 of the central bore 33, wherein the passages 62 provide fluid communication between the adjacent ones of the recesses forming the second portion 66. The passages 62 have a non-circular cross-sectional shape. For example, as shown, the passages 62 have an elliptical cross-sectional shape. However, it is understood the passages 62 can have circular cross-sectional shapes or other cross-sectional shapes as desired and/or due to forming or manufacturing the passages 62.

The passages 62 are angled with respect to the axial direction of the shaft 44, tapering from the central bore 33 to the bores 32 in a direction away from the second surface 40 of the cylinder housing 12, or the rear housing 16, towards the first surface 38 of the cylinder housing 12, or the front housing 14. The passages 62 intersect with the bores 32 at about 25% or greater of a length l of the bores 32 measured from the second surface 40 of the cylinder housing 12. Therefore, the passages 62 do not intersect with a first portion 32*a* of the bores 32, which represents the approximately 25% of the length l of the bores 32, and intersect with the bores 32 only at a second portion 32*b* of the length l of the bores 32, which represents approximately 75% of the length l of the bores 32. As a result, when the pistons 36 are directly adjacent the second surface 40 of the cylinder housing 12, or at about 0% of the length of the bores 32, and begin to move away from the second surface 40, the primary fluid from the suction chamber 28 only enters the bores 32 as the pistons 36 travels along the first portion 32*a* of the bores 32 and along the second portion 32*b* of the bores 32 until the pistons 36 pass the passages 62 in the second portion 32*b*. As the pistons 36 pass beyond the passages 62, then the supplemental fluid flowing through the passages 62 is drawn into the bores 32 for the remaining length of the stroke of the pistons 36 through the bores 32.

In an example, an intake amount of the primary fluid from the suction chamber 28 to the bores 32 as the pistons 36 move in a direction form the second surface 40 of the cylinder housing 12 to the first surface 38 of the cylinder housing 12, is represented by x for purposes of explanation. An intake amount of the supplemental fluid from the passages 62 to the bores 32 as the pistons 36 move in a direction form the second surface 40 of the cylinder housing 12 to the first surface 38 of the cylinder housing 12, is represented by y. Therefore, as the pistons 36 move from the second surface 40 of the cylinder housing 12 to the first surface 38 of the cylinder housing 12, a total amount of all compression fluids (i.e. The primary fluid and/or the supplemental fluid) entering the bores 32 is x from the second surface 40 of the cylinder housing 12 to directly before the passages 62. Then as the pistons 36 continue their stroke in the same direction, past the passages 62, the total amount of all compression fluids entering the bores 32 is equal to x+y until the end of the stroke of the pistons 36 in the same direction. Once the compression of the compression fluids is completed, the pistons 36 move in the opposite direction from the first surface 38 to the second surface 40 of the cylinder housing 12 to discharge the compressed fluids to the exhaust chamber 30.

The supplemental fluid flows from the vapor injection port 26, to the vapor injection chamber 34, around the shaft 44, and to the central bore 33. From the central bore 33, the supplemental fluid flows to the bores 32. The supplemental fluid is then compressed and exhausted with the primary fluid through the outlet 60 of the valve assembly 56 to the exhaust chamber 30 and outwardly from the compressor 10 through the exhaust port 24.

The rear housing 16 includes a crankcase pressure chamber 84 aligning with the central bore 33 of the cylinder housing 12 and concentric with the suction chamber 28. The crankcase pressure chamber 84 also is in axial alignment with the shaft 44. The crankcase pressure chamber 84 receives crankcase fluid (shown by the dotted arrow) from the front housing 14. A channel 72 is formed in the cylinder housing 12 to provide fluid communication between the crankcase pressure chamber 84 and the suction chamber 28. As such, crankcase fluid resulting from "blow by" of the fluid or the supplemental fluid passing by the pistons 36 into the crank chamber 43 of the front housing 14 can be conveyed to the suction chamber 28 through the channel 72 and recycled for suction by the pistons 36. Additionally, the shaft 44 includes a passageway 86 formed therethrough. The passageway 86 extends within the shaft 44 from the front housing 14 or directly adjacent the front housing 14 to an end of the shaft 44 adjacent the rear housing 16. The passageway 86 is in fluid communication with the front housing 14 via an inlet (not shown) formed in the shaft 44. The inlet is positioned within the central bore 33. However, it is understood, the inlet may be disposed within the front housing 14 if desired. The crankcase fluid, flowing through the shaft 44 can be conveyed from the central bore 33 to the crank case pressure chamber 84 to the suction chamber 28. A portion of the passageway 86 is an formed of an orifice 96 formed in the shaft adjacent the rear housing 16.

In an example, for a variable displacement compressor, the primary fluid flowing into the suction chamber 28 has a suction pressure $P_s$. The compressed fluid flowing to the exhaust chamber 30 has a discharge pressure $P_d$. The crankcase fluid has a crankcase pressure $P_c$. The crankcase pressure $P_c$ is a result of pressure controlling the amount of displacement of the pistons 36 in the cylinder housing 12. The supplemental fluid flowing into the vapor injection chamber 34 and then into the bores 32 has a vapor pressure $P_v$. The vapor pressure $P_v$ is greater than the suction pressure $P_s$ but less than the discharge pressure $P_d$. As a result, the greater vapor pressure $P_v$ is added to the suction pressure $P_s$ through the passages 62. The crank case pressure $P_c$ can be added to the suction pressure $P_s$, to increase the suction pressure $P_s$, through the channel 72.

The cylinder housing 12 includes a cylindrical protrusion 80 extending from a wall defining the crankcase pressure chamber 84 and receiving the end of the shaft 44. The protrusion 80 extends outwardly from an engaging surface 82 of the rear housing 16. As such, the protrusion 80 extends into the central bore 33 past the second surface 40 of the cylinder housing 12. As a result, since the protrusion 80 occupies additional space within the central bore 33, an expansion volume of the supplemental fluid is reduced or minimized since the protrusion 80 within the central bore 33 minimizes a volume in which the supplemental fluid can expand. Therefore, the density, the pressure, and the mass flow of the supplemental fluid is increased compared to a cylinder housing without the protrusion 80. Another advantage of the protrusion 80 is a length of the shaft 44 can be reduced since the shaft 44 does not extend into the rear housing 16 which reduces manufacturing costs.

In application, the compressor 10 receives the primary fluid from the first fluid source, such as from an evaporator of an HVAC, to the suction chamber 28. As the pistons 36 reciprocate in the bores 32, the pistons 36 compress and discharge the compressed fluid. As the pistons 36 move in the direction from the second surface 40 of the cylinder housing 12 to the first surface 38 of the cylinder housing 12, the primary fluid is sucked into the bores 32 from the suction chamber 28, through the valve assembly 56. Once the pistons 36 reach the passages 62, the supplemental fluid is also sucked into the bores 32 to be compressed with the primary fluid. The supplemental fluid is conveyed from the second fluid source, through the vapor injection chamber 34, the central bore 33, and the passages 62, to the bores 32. As a result, the supplemental fluid is directly combined into the bores 32 and the pressure of the primary fluid being compressed is increased. Since the passages 62 enter the bores 32 at the second portion **32*b* of the bores 32, an efficiency of the compressor 10 when the pistons 36 are in a minimum displacement (as shown in FIG. 3) is not compromised as a clearance or dead volume within the pistons 36 is not increased by placement of the passages 62 in the first portion 32*a* of the bores 32. The positioning of the passages 62 in the second portion 32*b* also does not inhibit the flow of the primary fluid flowing through the valve assembly 56, wherein the valve assembly 56 remains open for permitting the primary fluid to flow from the suction chamber 28**.

As the pistons 36 move from the first surface 38 to the second surface 40 of the cylinder housing 12, the compressed fluids are discharged through the valve assembly 56 to the exhaust chamber 30 and returned to the first fluid source and/or any of the other fluid sources. Any crankcase fluid can be return to the crankcase pressure chamber 84 from the front housing 14 via the passage way 86.

Figure 6:
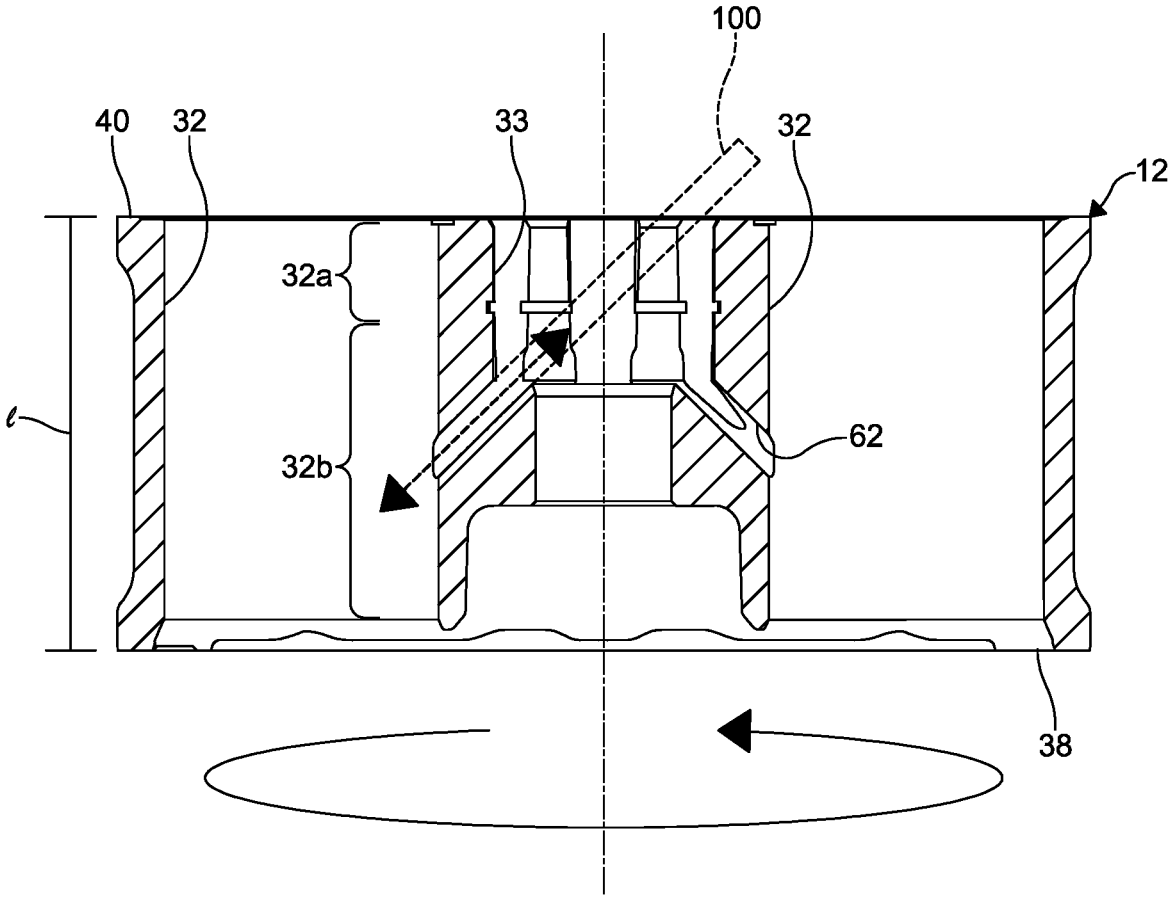
FIG. 6 is fragmentary left side cross-sectional elevational view of the cylinder housing of FIG. 4, wherein a method and process of forming the cylinder housing is schematically illustrated.

Advantageously, in the compressor 10 according to the instant disclosure, the density and mass flow of the compressed fluids is increased which maximizes efficiency without increasing a size of the compressor 10 or components of the compressor 10 which will increase costs A method of forming the passages 62 in the cylinder housing 12 will now be described with reference to FIG. 6. According to a first step, the bores 32, 33 are formed by an indexing process, a molding process, a stamping process, a boring process, a lathing process, a combination thereof, or any other process as desired or as commonly know in the art of forming cylinder housings for compressors. In a second step, a tool 100 such as a boring tool, a cutting tool, a knife, a laser, a saw, a torch, a heat element, or any other tool known to bore through material such as metal engages the wall 68 forming the central bore 33. Pressure is applied to the tool 100 to bore the passages 62 through the cylinder housing 12 to the bores 32. It is understood, the first step and the second step can occur separately or simultaneously.

According to an example, the bores 32, 33 are formed in the cylinder housing 12 by a turning apparatus such as a lathe for example. The bores 32 can be formed simultaneous or one at a time. The cylinder housing 12 rotates on the lathe 12 in a direction indicated by the solid arrow. As the cylinder housing 12 is rotated, the tool 100 is inserted into the central bore 33 at an angle with respect to an axial direction of the central bore 33 and can move inwardly and outwardly with respect to the central bore 33 in a direction indicated by the dashed arrow. The tool 100 applies pressure to the cylinder housing 12 intermediate the central bore 33 and the bores 32 to form the passages 62. The tool 100 can form each of the passages 62 during a single rotation of the cylinder housing 12 on the lathe.

The method of forming the passages 62 is advantageous because fewer steps occur compared to other methods. For example, another method may require a tool to be inserted through each of the bores 32 individually to form the passages 62 which will take six more steps in the cylinder housing 12 having six of the bores 32 or any amount of steps more depending on the number of the bores 32 in the cylinder housing 12. As a result of the method of the disclosure, manufacturing costs are minimized and quality control is maximized.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A piston type compressor comprising:

a main housing including a cylinder housing, the cylinder housing having a central bore for receiving a shaft therein through a first surface thereof and a plurality of bores configured for receiving a plurality of pistons therein through the first surface;

an inlet configured for conveying a primary fluid to the plurality of bores;

an outlet configured for conveying the primary fluid from the plurality of bores; and a plurality of passages separate from the inlet and the outlet, each of the plurality of passages formed in the main housing and configured for conveying a supplemental fluid to one of the plurality of bores, wherein the main housing further comprises a rear housing adjacent a second surface of the cylinder housing opposite the first surface, the rear housing having a suction chamber configured for conveying the primary fluid to the plurality of bores, an exhaust chamber configured for receiving the primary fluid from the plurality of bores, and a vapor injection chamber for conveying the supplemental fluid to the plurality of passages, wherein the rear housing further comprises a crankcase pressure chamber configured to receive a pressurized crankcase fluid, wherein the crankcase pressure chamber is concentric with the vapor injection chamber.

2. The compressor of claim 1, wherein a channel provides fluid communication between the suction chamber and the crankcase chamber.

3. The compressor of claim 1, wherein the rear housing includes an annular protrusion extending outwardly from an engaging surface of the rear housing, the protrusion continuous with the crankcase chamber and extending into the central bore of the cylinder housing.

4. The compressor of claim 1, wherein the exhaust chamber, the suction chamber, and the vapor injection chamber are concentric with each other.

5. The compressor of claim 1, wherein each of the plurality of passages extends through a wall defining a respective one of the plurality of bores.

6. The compressor of claim 1, wherein each of the plurality of passages provides fluid communication between the central bore and a respective one of the plurality of bores.

7. The compressor of claim 1, wherein each of the plurality of passages interfaces with the plurality of bores at greater than 25% of a length of the plurality of bores measured from the second surface of the cylinder housing opposite the first surface.

8. The compressor of claim 1, wherein each of the plurality of passages is angled with respect to an axial direction of the cylinder housing.

9. The compressor of claim 1, wherein the compressor is a variable displacement compressor.

10. The compressor of claim 1, wherein a wall defines a first portion of the central bore, the first portion of the central bore configured for receiving the shaft, and wherein the central bore includes a second portion defined by a plurality of recesses extending radially from the wall and continuous with the first portion of the central bore.

11. The compressor of claim 10, wherein the plurality of passages are continuous with adjacent ones of the plurality of recesses.

12. A piston type compressor comprising:

a cylinder housing, the cylinder housing having a central bore and a plurality of cylinder bores formed therethrough;

a shaft received through the central bore through a first surface of the cylinder housing;

a plurality of pistons reciprocating within the plurality of cylinder bores through the first surface of the cylinder housing;

a plurality of passages providing fluid communication between the central bore and the plurality of cylinder bores; and a rear housing adjacent a second surface of the cylinder housing opposite the first surface of the cylinder housing, the rear housing including a suction chamber conveying a primary fluid to the plurality of cylinder bores through the second surface of the cylinder housing, an exhaust chamber receiving the primary fluid from the plurality of cylinder bores, a vapor injection chamber conveying a supplemental fluid to the plurality of cylinder bores via the plurality of passages, and a crankcase pressure chamber receiving a crankcase fluid from the shaft, wherein the rear housing includes a protrusion extending outwardly therefrom, wherein the protrusion is received in the central bore of the cylinder housing, and wherein the shaft engages the protrusion.

13. The compressor of claim 12, wherein a passageway is formed in the shaft and conveys the crankcase fluid to the crankcase pressure chamber.

14. The compressor of claim 12, wherein a reciprocation of the plurality of pistons opens and closes the plurality of passages to the plurality of cylinder bores.

15. The compressor of claim 14, wherein the compressor operates in a first operational mode and a second operational mode, wherein a stroke length of the plurality of pistons within the plurality of cylinder bores during the first operational mode is constant and at a maximum stroke length, wherein a stroke length of the plurality of pistons within the plurality of bores during the second operation mode varies, and wherein the plurality of passages are closed by the plurality of pistons during the second operational mode.

* * * * *